US006470631B1

(12) United States Patent
Rechsteiner

(10) Patent No.: US 6,470,631 B1
(45) Date of Patent: Oct. 29, 2002

(54) CURVED AND/OR SPHERICAL ELEMENT FOR A SKATING RING

(75) Inventor: Erwin Rechsteiner, Neuwilen (CH)

(73) Assignee: Bowl Construction AG, Tägerwilen (CH)

( * ) Notice: Subject to any disclaimer, the term of this patent is extended or adjusted under 35 U.S.C. 154(b) by 0 days.

(21) Appl. No.: 09/509,737

(22) PCT Filed: Oct. 2, 1998

(86) PCT No.: PCT/IB98/01685

§ 371 (c)(1),
(2), (4) Date: Jun. 1, 2000

(87) PCT Pub. No.: WO99/17848

PCT Pub. Date: Apr. 15, 1999

(30) Foreign Application Priority Data

Oct. 2, 1997 (DE) ..... 197 43 807

(51) Int. Cl.[7] ..... E04D 7/08

(52) U.S. Cl. ..... 52/81.1; 472/92; 472/88; 472/89; 52/80.1; 52/288; 52/204; 14/69.5

(58) Field of Search ..... 52/80.1, 80.2, 52/81.2, 246, 152, 483.1; 472/85, 89, 92, 117

(56) References Cited

U.S. PATENT DOCUMENTS 4,023,317 A * 5/1977 Bettger et al. ..... 52/204
4,893,447 A * 1/1990 Opp et al. ..... 52/288
5,137,497 A * 8/1992 Dubeta ..... 472/88
5,524,310 A * 6/1996 Farnen ..... 14/69.5
5,660,595 A * 8/1997 Ferro, Jr. et al. ..... 472/92
6,042,480 A * 3/2000 Labelson ..... 472/89
6,093,109 A * 7/2000 Eden et al. ..... 472/92
6,134,849 A * 10/2000 Holler ..... 52/80.1

* cited by examiner

*Primary Examiner*—Carl D. Friedman
*Assistant Examiner*—Steve Varner
(74) *Attorney, Agent, or Firm*—John S. Reid; Reidlaw, L.L.C.

(57) ABSTRACT

The invention includes methods and apparatus for fabricating a skating ring. One such apparatus is a curved element for skating rings which includes a plurality of vertical sup5 ports which are adapted to any curve shape. The apparatus further includes a plurality of horizontally arranged ribs and abutting double-curved shell segments made of several plane-like wood layers which are glued to each other. By being fixed to the support elements and ribs, the shell segments form a skating surface to be ridden on by skaters or the like. The shell segments are pre-shaped as at least one of single- or double-curves such that they can be fixed essentially stress-free onto the support elements and ribs. One method of the present invention includes a method for manufacturing shell segments for curve elements for skating rings. The shell segments include a plurality of plane-like layers of wood. The method includes the steps of bending each individual layer of wood into the final shape, stacking the individual bent layers of wood to manufacture a shell segment, and joining the individual stacked layers of wood without the application of stress.

7 Claims, 2 Drawing Sheets

CURVED AND/OR SPHERICAL ELEMENT FOR A SKATING RING

CROSS REFERENCE TO RELATED APPLICATIONS

This application claims priority to Patent Cooperation Treaty (PCT) application number PCT/IB98/01685, filed Oct. 2, 1998, which in turn claims priority to German patent application number 197 43 807.5, filed Oct. 2, 1997.

FIELD OF THE INVENTION

The invention pertains curved elements for forming the skating surface of a skating ring. The invention includes a single- or double-curved pre-shaped shell segment made of wood whereby the shell segment forms the skating surface of a skating ring.

BACKGROUND OF THE INVENTION

Skating rings, in particular those used by inline skaters, bicycle riders or similar, exist in numerous indoor and outdoor variations. The skating rings are comprised of many individual elements that are placed adjacent to each other, whereby the elements display straight, sloping, arched or curved or cylindrical respectively, spherical or similar skating surfaces. The skating surfaces can be made of wood, steel, plastic or concrete.

The curved elements found in the skating rings, for example in so called bowls, are manufactured in such a manner that flat shell segments made of wood or steel are fitted onto a base scaffold made of wood or steel whose contour approximately forms a bowl. Here the shell segments which were first cut to size are fastened on one side to the base scaffold in order to be able to attach the remaining surface by the use of bending force. Due to this undefined pressing down of the shell segments it is not always possible to achieve a smooth transition to the next shell segment.

In addition it is impossible to bend such large and highly stressed shell segments in two directions so that steps arise at the seams to the adjacent shell segments which inevitably lead to falls and therefore can lead to significant injuries.

A single curved shell segment of the art mentioned for curved elements for skating rings is known from DE U 90 10 527 whereby this shell segment is made of several plane-like wood layers which are glued together. By placing abutting shell segments onto a base scaffold a skating surface (for skaters) is formed. The disadvantage of this known shell segment is that these non-pre-shaped shell segments can only be attached to the base scaffold by the use of bending force. This leads to difficulties during construction and to steps and cracks between the abutting shell segments.

It is furthermore not possible to realize a uniform spherical skating surface for so-called bowls as there is no simple solution for the manufacture of pre-shaped double curved shell segments.

Such shell segments, i.e. shell segments that have adopted their final and lasting double-curved form due to a prefabrication, cannot be manufactured using conventional processes and plants. Such conventional processes are as a rule conceived for the manufacture of pre-formed parts for furniture in large numbers, whereby the pre-formed parts are developed as double-curved shell segments. The starting material is as a rule glued multiply plywood sheet which already exhibits the final thickness of the pre-formed part. As such pre-formed parts are significantly thinner and smaller than the double-curved shell segments for curved elements for skating rings the known plants are not capable of raising the necessary force in order to manufacture the shell segments according to the invention from conventional multiply plywood sheets. Indeed an appropriate enlargement of such plants is conceivable in order to manufacture the shell segments according to the invention using conventional processes, it is however to be expected that during the bending of thick shell segments cracks in the surface would result, especially in those places with increased tensile stress.

In addition such plants would be due to their size and complexity so cost intensive that the manufacturing costs of the shell segments would not be economically justifiable.

For this reason the objective of the invention is

- to create a shell segment for curved elements for complex skating rings whose manufacturing and fabrication expense is minor, as well as
- to indicate a process for the manufacture of pre-shaped single- and double-curved shell segments made of wood.

SUMMARY OF THE INVENTION

The objective described above is achieved by pre-shaping the shell segments before the construction begins so that they can subsequently be fixed free of stress and precisely onto the skating ring scaffold.

The objective is also met in that a process for the manufacture of such shell segments is recommended which is characterized by the following process steps:

a. each individual layer of wood is bent into it's final shape;

b. the bent individual layers of wood are stacked to manufacture a shell segment;

c. the individual stacked layers of wood are joined without the application of stress.

The main advantage of the invention is that in particular the so-called bowls can be cost effectively and simply manufactured or constructed respectively. This applies also for the curved elements which are individually laid out for the requirements as well as those for the existing skating rings.

This results in a skating surface that is free of steps and partial holes.

In addition it proves to be of advantage that due to the almost stress-free fitting of the shell segments onto the scaffold, which preferably is comprised of vertical support elements and horizontally running ribs, very few cracks occur in the skating surface.

It is of advantage that the shell segments are comprised of individual layers of wood which are laid on top of each other and joined to each other. Each layer of wood is preferably bent on a clamping device and then laid without the application of stress on to a further layer of wood and joined to it.

Preferably the shell segments are made of wood so that the individual layers of wood can be glued to each other.

Due to the CIM technology (computer aided machining of the support columns, the ribs and computer aided bending of the shell segments) applied here it is also possible to precisely manufacture the vertical support elements and the horizontally arranged ribs which join the support elements to each other.

The support elements and the ribs are developed in such a way that they contact the underside of the shell segments at least along a line of contact, preferably along a surface of contact. The bearing surface elements which are placed on the sides of the support elements assist the surface contact of the shell segments.

Further advantageous executions follow from the sub-claims and the description. The following drawings are shown:

DETAILED DESCRIPTION OF THE PREFERRED EMBODIMENTS OF THE INVENTION

Figure 1:
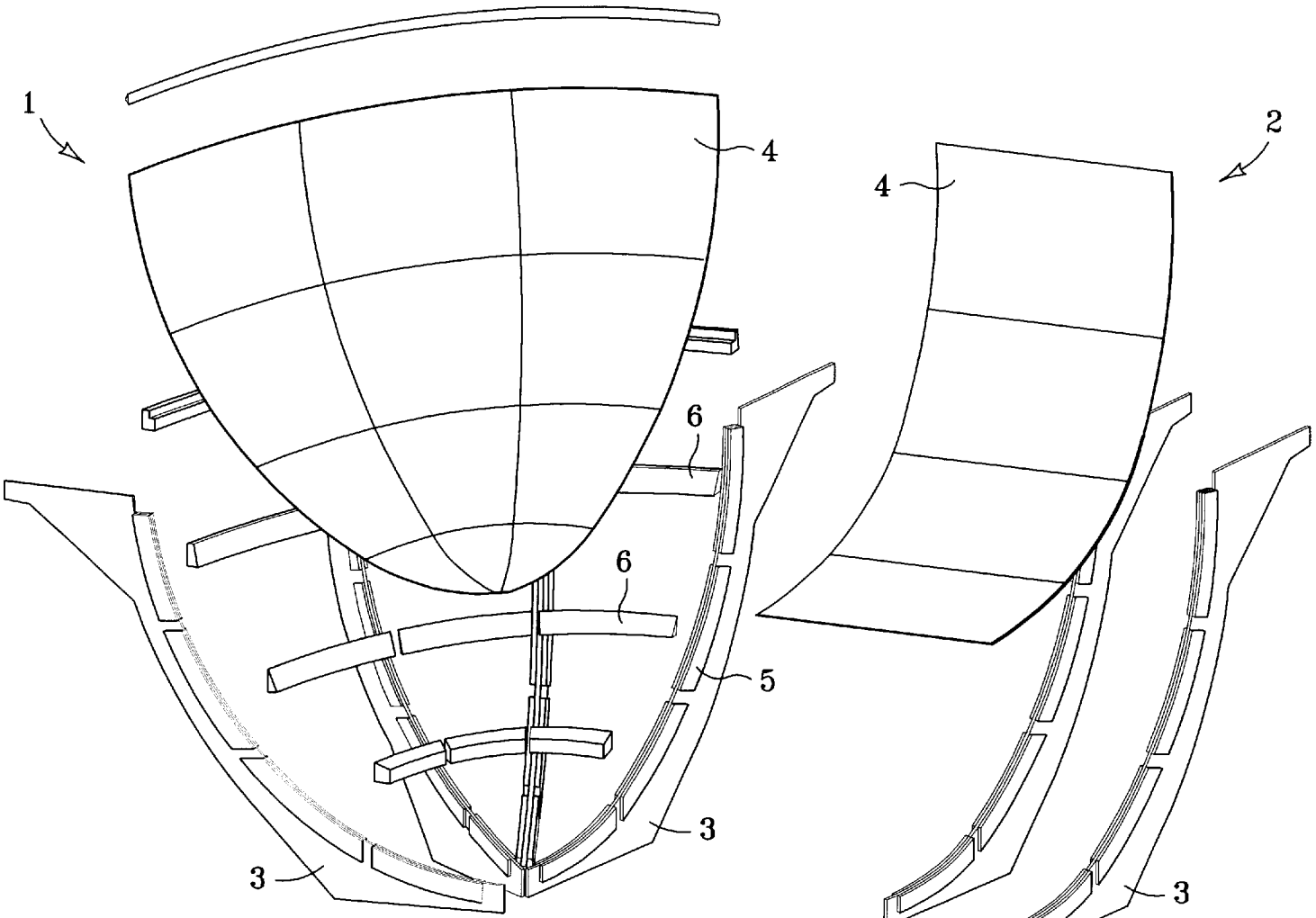
FIG. 1 is a perspective view of a so-called bowl with a connecting cylindrical element, each shown in exploded view.
Figure 2:
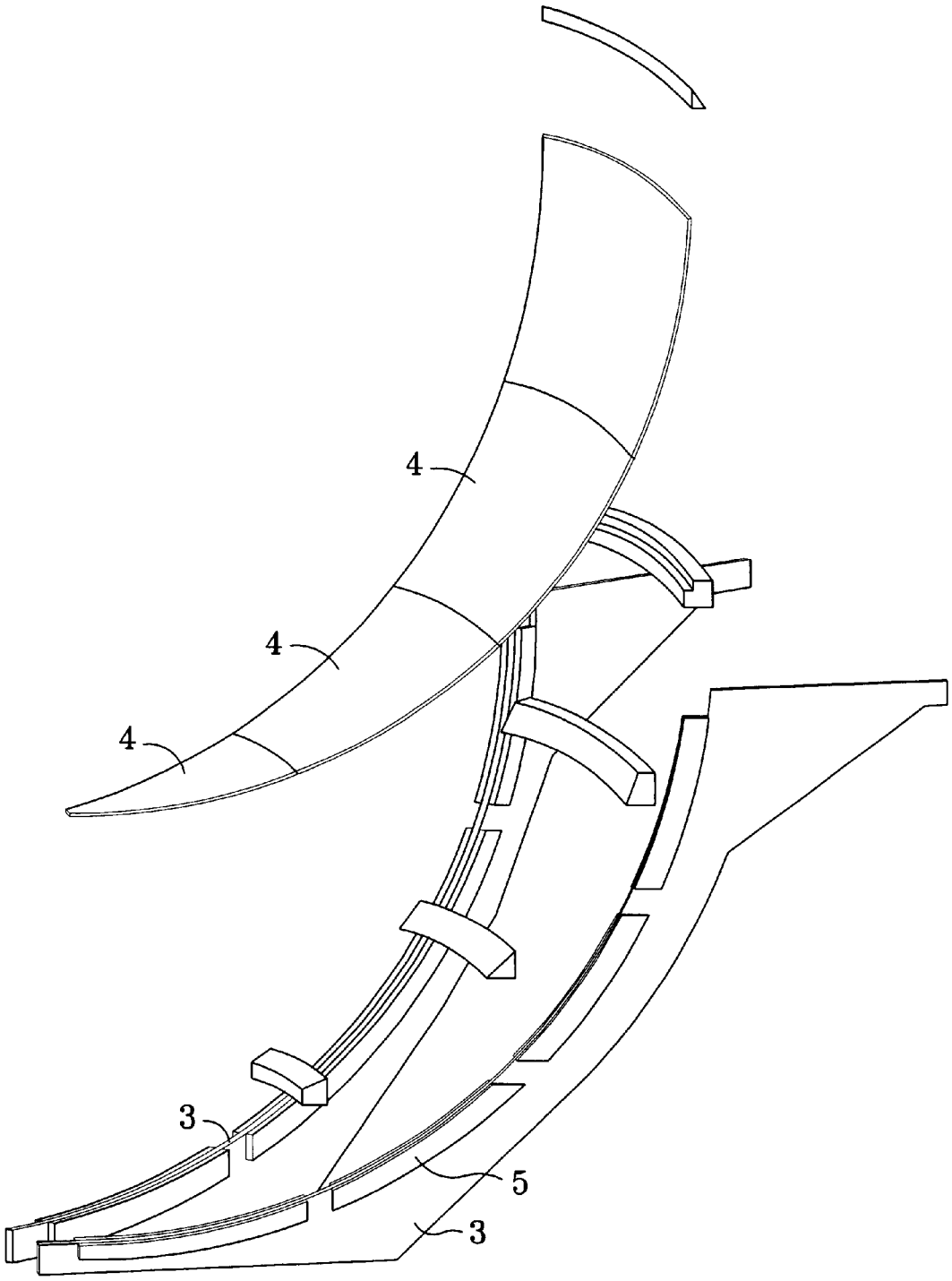
FIG. 2 is a perspective view of a segment of the bowl according to FIG. 1, also shown in an exploded view.

In FIG. 1 a perspective view of a bowl 1 is shown. This bowl 1 is part of a skating ring which has not been more closely shown, whereby any element such as the cylindrical element 2 which is also shown in FIG. 1.

The bowl 1 is comprised of a plurality of vertical support elements 3, which are arranged in a star shape, and shell segments 4, which are fixed onto the vertical support elements 3. It is of advantage that the shell segments are comprised of individual layers of wood which are laid on top of each other and joined to each other. Each layer of wood is preferably bent on a clamping device and then laid without the application of stress on to a further layer of wood and joined to it. Preferably the shell segments are made of wood so that the individual layers of wood can be glued to each other. The abutting shell segments (4) can each exhibit tongue and groove elements.

In addition the support elements 3 exhibit bearing surface elements 5 which provide a better surface area for the support of the shell segments 4.

In the example of the invention shown in the drawings ribs 6, which are spaced apart from each other, are arranged between the support elements 3. The ribs 6 hold the vertical support elements 3 apart from each other and also serve to provide a support surface for the shell segments 4.

Larger bowls are provided on the outer end of the support elements 3 with support columns (not shown in the drawings) which are directed perpendicularly downwards in order to absorb the moments which occur on the outer edge of the bowl.

What is claimed is:

1. A curved shell segment (4) for curved elements for skating rings having vertical support elements, the shell segment comprised of wood layers which are glued to each other, whereby each curved shell segment is bent into its final shape before being fixed onto the vertical support elements without the application of stress to form a curved shell segment (4), whereby the shell segment (4) forms the skating surface of a skating ring, and wherein the abutting shell segments (4) each exhibit tongue and groove elements.

2. A curve element according to at claim 1, and wherein at the end of the shell segment (4), which ends at the outer-most end of the curve element in respect to the middle point of the curve element, an essentially perpendicular flat surface is provided.

3. Curve element according claim 2, characterized in that the form of the curved vertical support elements (3) corresponds to the actual bending moment along the vertical support elements (3).

4. Curve element according to claim 2, characterized in that the shell segments (4) are connectable to the vertical support elements (3).

5. A curve element according to claim 1, and wherein the vertical support element (3) further comprises bearing surface elements (5) which are arranged on each side of the support element (3), and the bearing surface elements (5) are spaced apart from each other.

6. The curved shell segment (4) of claim 1, and wherein each wood layer of the shell segment is bent into its final shape before being glued to the other wood layers.

7. The curved shell segment (4) of claim 1, and wherein the shell segment is curved into a double-curve before being fixed onto the vertical support element.

* * * * *